US011211738B2

(12) United States Patent
Uematsu et al.

(10) Patent No.: US 11,211,738 B2
(45) Date of Patent: Dec. 28, 2021

(54) COMPOSITE-CABLE RELAY DEVICE

(71) Applicant: Fanuc Corporation, Yamanashi (JP)

(72) Inventors: Hidetoshi Uematsu, Yamanashi (JP); Leo Arai, Yamanashi (JP)

(73) Assignee: FANUC CORPORATION, Yamanashi (JP)

( * ) Notice: Subject to any disclaimer, the term of this patent is extended or adjusted under 35 U.S.C. 154(b) by 21 days.

(21) Appl. No.: 16/937,427

(22) Filed: Jul. 23, 2020

(65) Prior Publication Data

US 2021/0066846 A1 Mar. 4, 2021

(30) Foreign Application Priority Data

Aug. 30, 2019 (JP) ..... JP2019-157801

(51) Int. Cl.

| | |
|---|---|
| ***H01R 13/518*** | (2006.01) |
| ***H01B 7/00*** | (2006.01) |
| ***H01R 27/00*** | (2006.01) |
| ***H01R 25/00*** | (2006.01) |

(52) U.S. Cl.

CPC ..... *H01R 13/518* (2013.01); *H01B 7/009* (2013.01); *H01R 25/006* (2013.01); *H01R 27/00* (2013.01); *H01R 2201/10* (2013.01)

(58) Field of Classification Search

CPC ..... H01R 13/518; H01R 27/00; H01R 31/06; H01R 31/02; H01R 25/003

USPC ..... 439/502, 505, 638, 498

See application file for complete search history.

(56) References Cited

U.S. PATENT DOCUMENTS

| | | | | |
|---|---|---|---|---|
| 8,235,748 | B2 * | 8/2012 | Lacey | H02G 3/18 439/535 |
| 8,939,789 | B2 * | 1/2015 | Lisbona | H01R 29/00 439/490 |
| 2002/0119706 | A1 * | 8/2002 | Sagues | G05B 19/054 439/638 |
| 2004/0002256 | A1 * | 1/2004 | Bauermeister | H01R 13/665 439/502 |
| 2006/0019542 | A1 * | 1/2006 | Wu | H01R 25/00 439/638 |

(Continued)

FOREIGN PATENT DOCUMENTS

| | | | |
|---|---|---|---|
| EP | 3379702 | A1 | 9/2018 |
| JP | 2008-301544 | A | 12/2008 |

(Continued)

*Primary Examiner* — Gary F Paumen

(74) *Attorney, Agent, or Firm* — Shackelford, Bowen, McKinley & Norton, LLP

(57) ABSTRACT

The present invention provides a composite-cable relay device that connects individual wiring lines of a composite cable to two or more motor-side connectors included in a motor, the composite-cable relay device including: two or more relay-side connectors that are connected to the respective motor-side connectors; hollow housings that are secured to at least one of the relay-side connectors; a relay cable that possesses flexibility and that connects the hollow housings and the other relay-side connectors, wherein a connecting portion to which the composite cable is connected is provided in the hollow housings, and, in the interior of the hollow housing, wiring to be connected to the relay-side connector secured to the hollow housing and wiring to be connected to the relay cable branch off from each other.

4 Claims, 6 Drawing Sheets

(56) References Cited

U.S. PATENT DOCUMENTS

| | | | | |
|---|---|---|---|---|
| 2009/0174991 | A1* | 7/2009 | Mahdavi | H01R 27/02 361/679.02 |
| 2010/0291794 | A1* | 11/2010 | Luo | H01R 31/06 439/502 |
| 2012/0315787 | A1* | 12/2012 | Wiest | H01R 13/5845 439/502 |
| 2013/0344746 | A1* | 12/2013 | Andersson | H01R 31/005 439/638 |
| 2014/0120765 | A1* | 5/2014 | Lombardo | H01R 25/003 439/501 |
| 2017/0149310 | A1 | 5/2017 | Takenaka et al. | |
| 2017/0250589 | A1 | 8/2017 | Nakamura et al. | |

FOREIGN PATENT DOCUMENTS

| | | | |
|---|---|---|---|
| JP | 2009-193760 | A | 8/2009 |
| JP | 2013-046506 | A | 3/2013 |
| JP | 2017-158223 | A | 9/2017 |
| WO | WO-2017085872 | A1 | 5/2017 |

* cited by examiner

COMPOSITE-CABLE RELAY DEVICE

CROSS-REFERENCE TO RELATED APPLICATIONS

This application is based on Japanese Patent Application No. 2019-157801, the contents of which are incorporated herein by reference.

TECHNICAL FIELD

The present disclosure relates to a composite-cable relay device.

BACKGROUND ART

In general, connectors that can be connected to a motive-power cable, a brake cable, and an encoder cable are provided in servomotors of industrial robots. On the other hand, a composite cable in which a motive-power cable, a brake cable, and an encoder cable are integrated is used in some cases in order to reduce the number of man-hours for wiring the cables and to reduce wiring space (for example, see Patent Literature 1).

CITATION LIST

Patent Literature

{PTL 1} Japanese Unexamined Patent Application, Publication No. 2009-193760

SUMMARY OF INVENTION

An aspect of the present disclosure is a composite-cable relay device that connects individual wiring lines of a composite cable to two or more motor-side connectors included in a motor, the composite-cable relay device including: two or more relay-side connectors that are connected to the respective motor-side connectors; hollow housings that are secured to at least one of the relay-side connectors; and a relay cable that possesses flexibility and that connects the hollow housings with the other relay-side connectors, wherein a connecting portion to which the composite cable is connected is provided in any one of the hollow housings, and, in the interior of each hollow housing, wiring to be connected to the relay-side connector secured to the hollow housing and wiring to be connected to the relay cable branch off from each other.

DESCRIPTION OF EMBODIMENT

A composite-cable relay device 1 according to an embodiment of the present disclosure will be described below with reference to the drawings.

Figure 3:
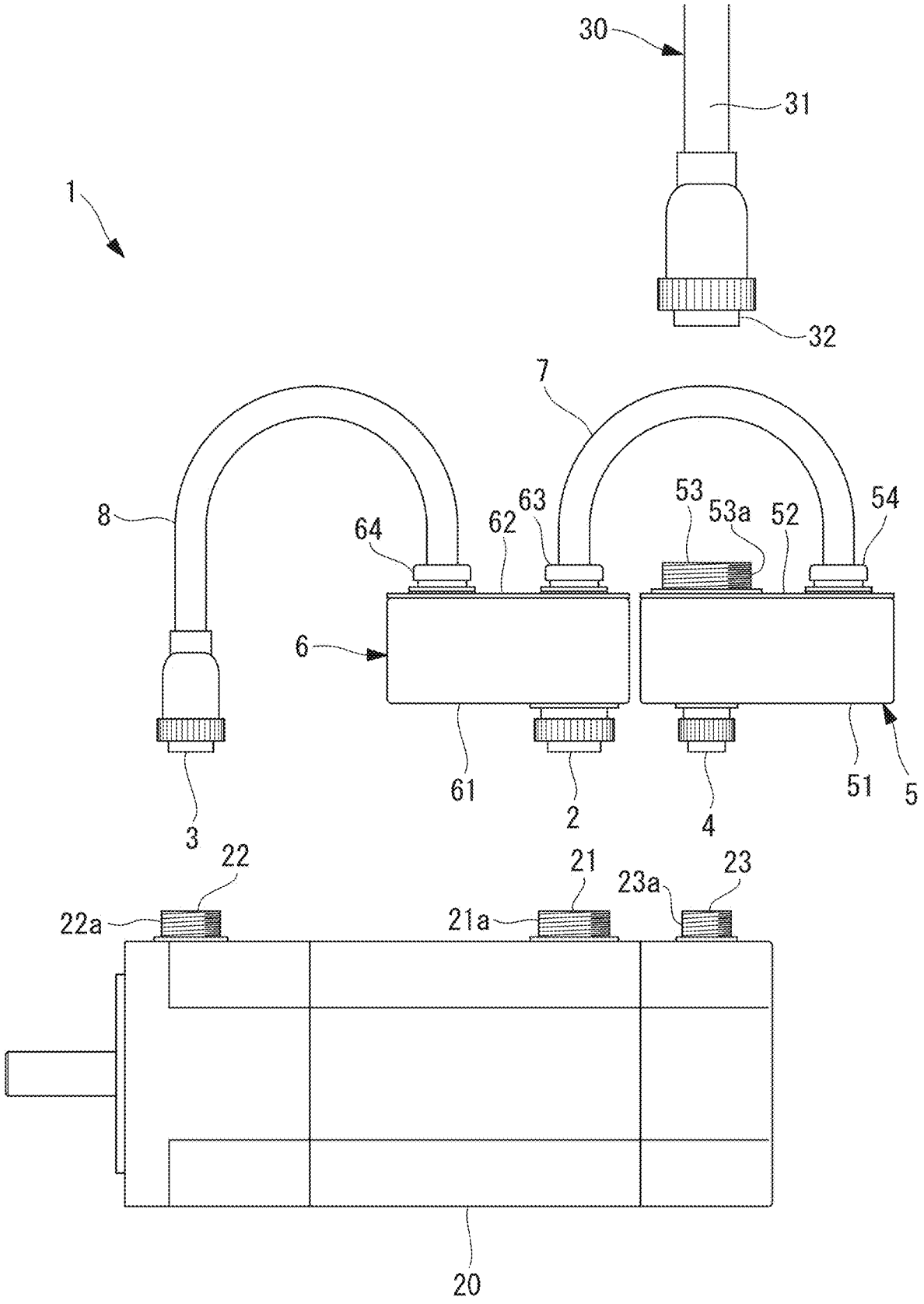
FIG. 3 is an exploded view for explaining the work involved in connecting a composite cable to a motor by using the composite-cable relay device in FIG. 1.

As shown in FIG. 3, the composite-cable relay device 1 according to this embodiment is a device that relays individual wiring lines of a composite cable 30 to a motive-power connector (motor-side connector) 21, a brake connector (motor-side connector) 22, and an encoder connector (motor-side connector) 23 included in a motor 20.

In other words, as shown in FIG. 3, the composite cable 30 is an unbranched single cable that includes all of motive-power wiring, brake wiring, and encoder wiring, and that is covered with an external insulation sheath 31 in a single bundle.

In FIG. 3, the composite-cable relay device 1 according to this embodiment is shown in the form in which the composite cable 30 has a composite connector (cable-side composite connector, i.e., connecting portion) 32.

The motive-power connector 21, the brake connector 22, and the encoder connector 23 respectively have male threads 21*a*, 22*a*, and 23*a* on outer circumferences thereof. A publicly known fastening structure is involved, in which, as a result of engaging and fastening, with the male threads 21*a*, 22*a*, and 23*a*, female threads of fastening rings included in first to third connectors 2, 3, and 4 (described later) in a rotatable manner, the connectors 2, 3, and 4 and the connectors 21, 22, and 23 are secured to each other in a state in which terminals of the connectors 2, 3, and 4 and those of the connectors 21, 22, and 23 are connected to each other.

Figure 1:
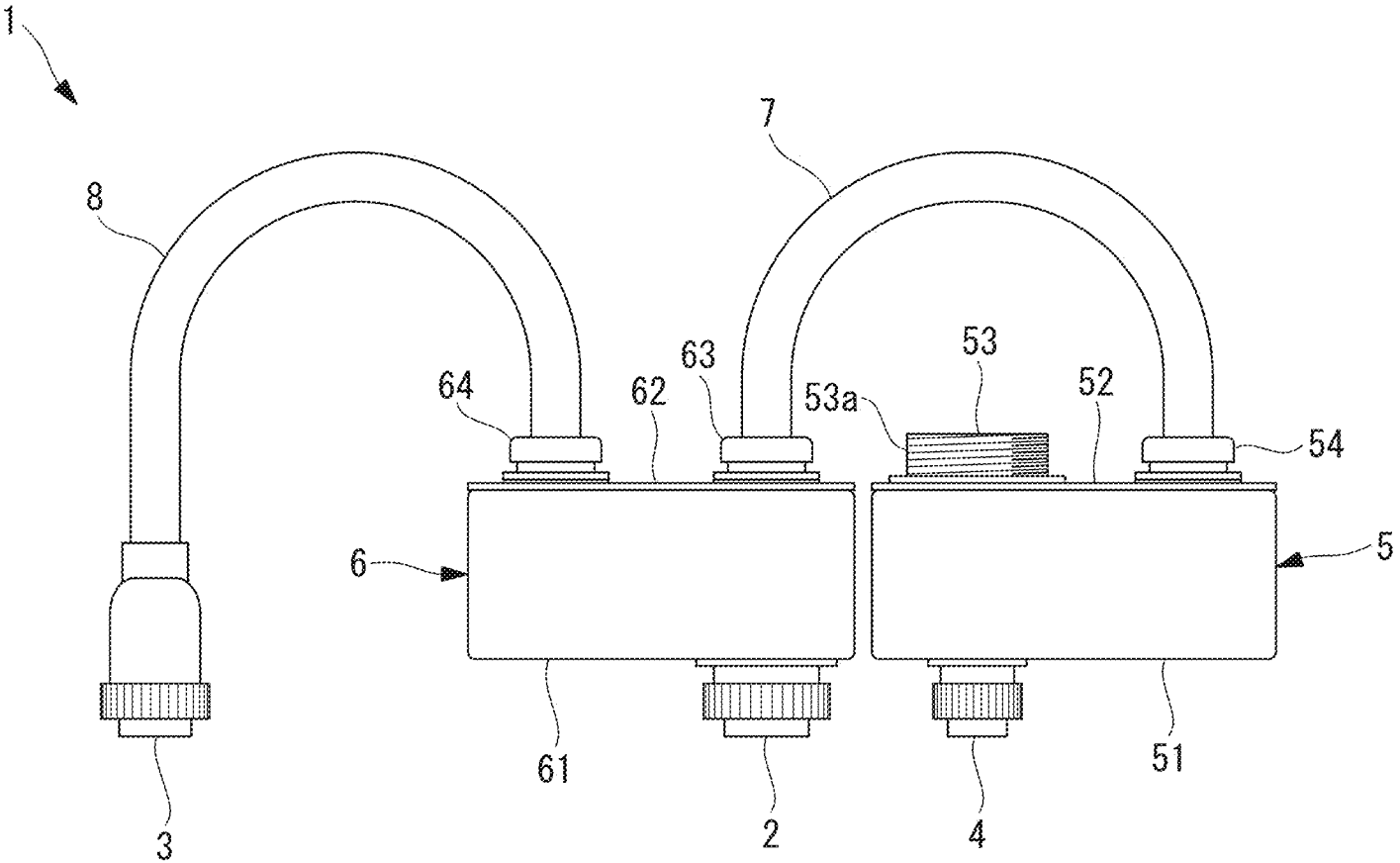
FIG. 1 is a front view showing a composite-cable relay device according to an embodiment of the present disclosure.

As shown in FIG. 1, the composite-cable relay device 1 is provided with the first to third connectors (relay-side connectors) 2, 3, and 4 that can respectively be connected to the motive-power connector 21, the brake connector 22, and the encoder connector 23 of the motor 20. The composite-cable relay device 1 includes first and second housings (hollow housings) 5 and 6 and first and second relay cables (relay cables) 7 and 8 having flexibility and appropriate lengths.

Figure 2:
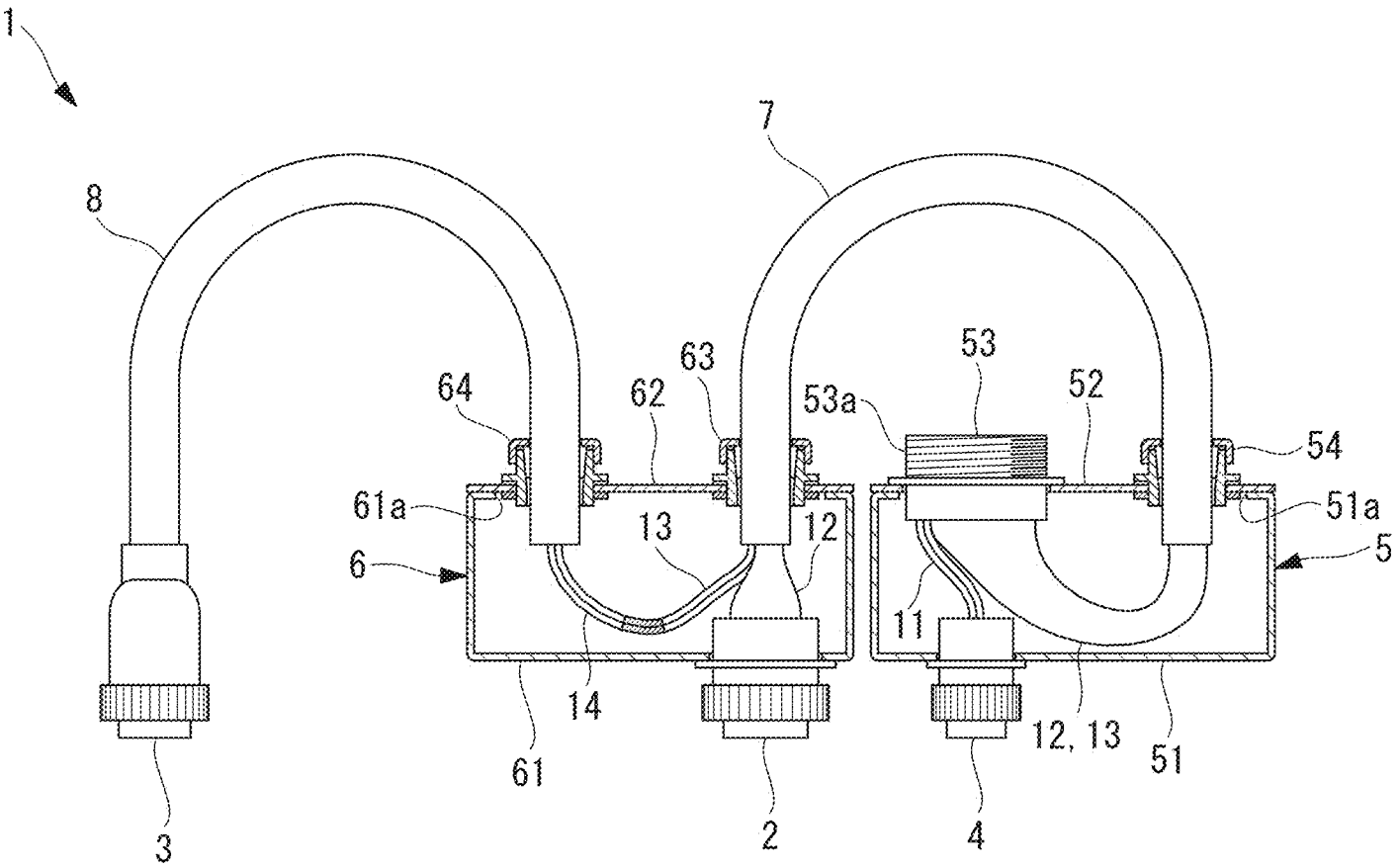
FIG. 2 is a longitudinal sectional view showing the structure of the composite-cable relay device in FIG. 1.

The first housing 5 and the second housing 6 respectively include, for example, as shown in FIG. 2, box-like housing bodies 51 and 61 that are open in one direction, and lids 52 and 62 that are attached to the housing bodies 51 and 61, for example, by means of screws, so that openings 51*a* and 61*a* of the housing bodies 51 and 61 can be opened/closed. The third connector 4, which is to be connected to the encoder connector 23 of the motor 20 in an attachable/detachable manner, is secured to the bottom surface of the housing body 51 of the first housing 5.

A relay-side composite connector (connecting portion) 53 is secured to the lid 52 of the first housing 5, and one end of the first relay cable 7 is secured to the lid 52 by means of a cable clamp 54. A male thread 53*a* to which a female thread of a fastening ring of the composite connector 32 of the composite cable 30 can be fastened is also provided on an outer circumference of the relay-side composite connector 53.

Also, only encoder wiring (wiring) 11 is connected between terminals (not shown) of the relay-side composite connector 53 secured to the first housing 5 and the terminals of the third connector 4.

Motive-power wiring (wiring) 12 and brake wiring (wiring) 13 included in the first relay cable 7 are connected to other terminals of the relay-side composite connector 53.

The first connector 2, which is to be connected to the motive-power connector 21 of the motor 20 in an attachable/detachable manner, is secured to the bottom surface of the housing body 61 of the second housing 6. The other end of the first relay cable 7 is secured to the lid 62 of the second housing 6 by means of a cable clamp 63, and one end of the second relay cable 8 is secured to the lid 62 by means of a cable clamp 64.

The motive-power wiring 12 in the first relay cable 7 is connected to the terminals of the first connector 2 secured to the second housing 6. The brake wiring 13 in the first relay cable 7 is connected to, in the interior of the second housing 6, wiring 14 that is led into the second housing 6 from the one end of the second relay cable 8.

The wiring 14 of the second relay cable 8 is connected to the second connector 3 secured to the other end of the second relay cable 8.

The operation of the thus-configured composite-cable relay device 1 according to this embodiment will be described below.

Figure 4:
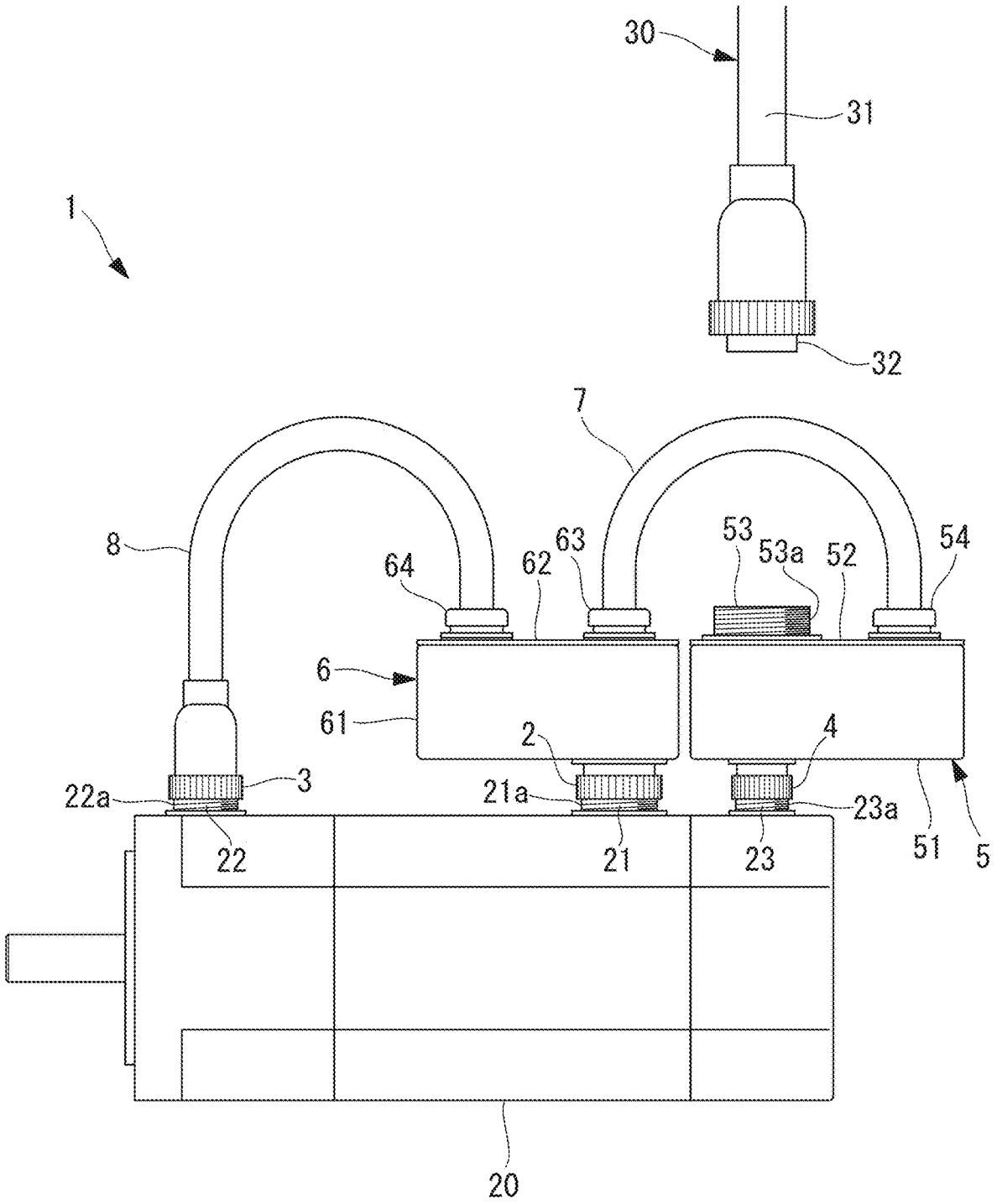
FIG. 4 is an exploded view showing a state in which the composite-cable relay device in FIG. 1 is attached to the motor in FIG. 3.

In order to attach the composite-cable relay device 1 according to this embodiment to the motor 20, the third connector 4 secured to the first housing 5 is connected to the encoder connector 23 of the motor 20, as shown in FIG. 4.

The first connector 2 secured to the second housing 6 is connected to the motive-power connector 21 of the motor 20. Then, the second connector 3 provided at the other end of the second relay cable 8 is connected to the brake connector 22 of the motor 20. By doing so, the composite-cable relay device 1 is attached to the motor 20.

Figure 5:
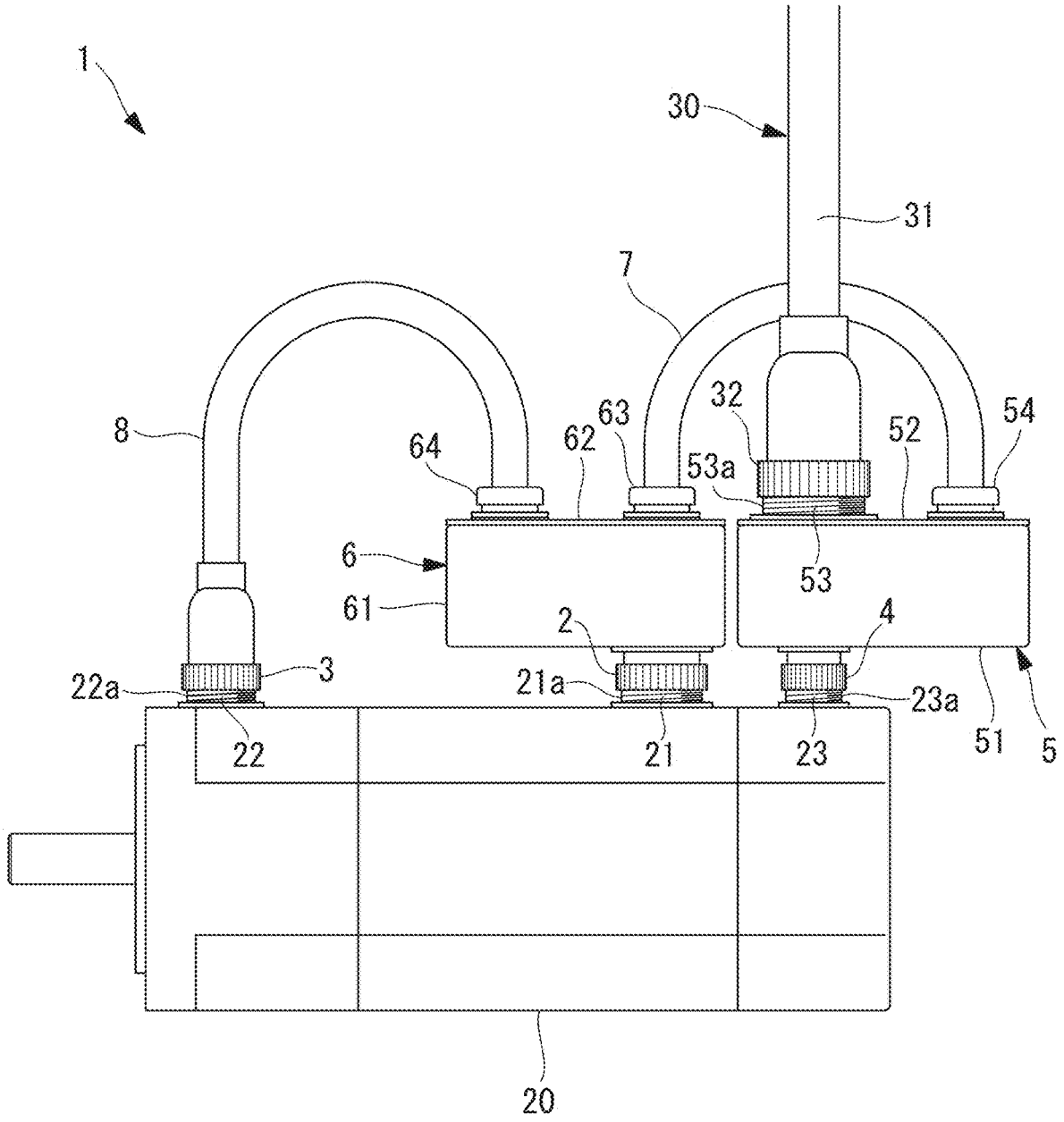
FIG. 5 is a diagram showing a state in which the composite cable is connected to a relay-side composite connector of the composite-cable relay device in FIG. 4.

In this state, as shown in FIG. 5, the composite connector 32 of the composite cable 30 is fastened to the relay-side composite connector 53 included in the first housing 5. By doing so, the motive-power wiring, the brake wiring, and the encoder wiring included in the composite cable 30 are connected to the motor 20.

Specifically, the encoder wiring included in the composite cable 30 is connected to the encoder connector 23 of the motor 20 via the composite connector 32 of the composite cable 30, the relay-side composite connector 53, the encoder wiring 11, and the third connector 4. The motive-power wiring included in the composite cable 30 is connected to the motive-power connector 21 of the motor 20 via the composite connector 32 of the composite cable 30, the relay-side composite connector 53, the motive-power wiring 12 included in the first relay cable 7, and the first connector 2.

The brake wiring included in the composite cable 30 is connected to the brake connector 22 of the motor 20 via the composite connector 32 of the composite cable 30, the relay-side composite connector 53, the brake wiring 13 included in the first relay cable 7, the wiring 14 of the second relay cable 8, and the second connector 3.

With the thus-configured composite-cable relay device 1 according to this embodiment, it is possible to adjust the positions of the first to third connectors 2, 3, and 4 by bending the two relay cables 7 and 8. In other words, even if the positions of the motive-power connector 21, the brake connector 22, and the encoder connector 23 on the motor 20 are different, it is possible to absorb the changes in the positions by deformation of the relay cables 7 and 8, which possess flexibility.

It is possible to connect all of the motive-power wiring 12, the brake wiring 13, and the encoder wiring 11 to the motor 20 simply by connecting the composite connector 32 of the composite cable 30 to the relay-side composite connector 53 provided in the first housing 5. Accordingly, the types of all of the connectors 2, 3, 4, 21, 22, and 23 match, and there is an advantage in that it is possible to perform wiring work simply by connecting the composite cable 30 even with a motor 20 in which the arrangement of the connectors 21, 22, and 23 is different.

With this embodiment, it is possible to secure the first housing 5, to which the third connector 4 is secured, to the motor 20 in a simple manner by fastening the third connector 4 to the encoder connector 23 of the motor 20. It is possible to secure the second housing 6, to which the first connector 2 is secured, to the motor 20 in a simple manner by fastening the first connector 2 to the motive-power connector 21 of the motor 20.

Because the two relay cables 7 and 8 are attached to the first housing 5 and the second housing 6, it is possible to restrict free movement of the relay cables 7 and 8 in a state in which the composite-cable relay device is attached to the motor 20. In other words, in the case in which the motor 20 is attached to a movable part of a robot, it is possible to prevent the relay cables 7 and 8 from violently moving due to the movement of the movable part.

Because the single composite connector 32 is simply attached without branching the end of the composite cable 30, it is possible to simplify the structure of the composite cable 30, and it is possible to achieve cost reduction and to enhance the ease of manufacturing. Because the end of the composite cable 30 is not branched, it is possible to enhance the performance in terms of the shielding property, the liquid resistance, the dust resistance, and so forth.

With the composite-cable relay device 1 according to this embodiment, a structure such as the first housing 5 or the second housing 6 is included, and it is not necessary to separately provide a distribution box in order to enhance the performance in terms of the shielding property, the liquid resistance, the dust resistance, and so forth. Because of this, it is not necessary to secure a distribution box to the body of the motor 20 as in the case in which a distribution box is included.

In other words, with the composite-cable relay device 1 according to this embodiment, as a result of connecting the connectors 2 and 4 to the motive-power connector 21 and the encoder connector 23 of the motor 20, respectively, it is possible to freely secure, in those connecting portions, the housings 5 and 6 to the motor 20 within the range of the lengths of the relay cables 7 and 8 regardless of the size of the motor 20. Therefore, it is less likely that a problem occurs when selecting places for installing the housings 5 and 6 in the motor 20, it is not necessary to provide spaces, threads, and so forth for securing the housings 5 and 6 to the body of the motor 20, and it is possible to easily secure the housings 5 and 6 to an existing motor without having to apply any processing thereto.

In this embodiment, although the composite-cable relay device 1 for joining the composite cable 30 to the motor 20 having the three motor-side connectors 21, 22, and 23 has been described as an example, alternatively, the present invention may be applied to a case in which the composite cable 30 is connected to a motor 20 having two or at least four motor-side connectors 21, 22, and 23. In any of those cases, the numbers of the hollow housings 5 and 6 and the relay cables 7 and 8 become one less than the number of the motor-side connectors 21, 22, and 23.

Figure 6:
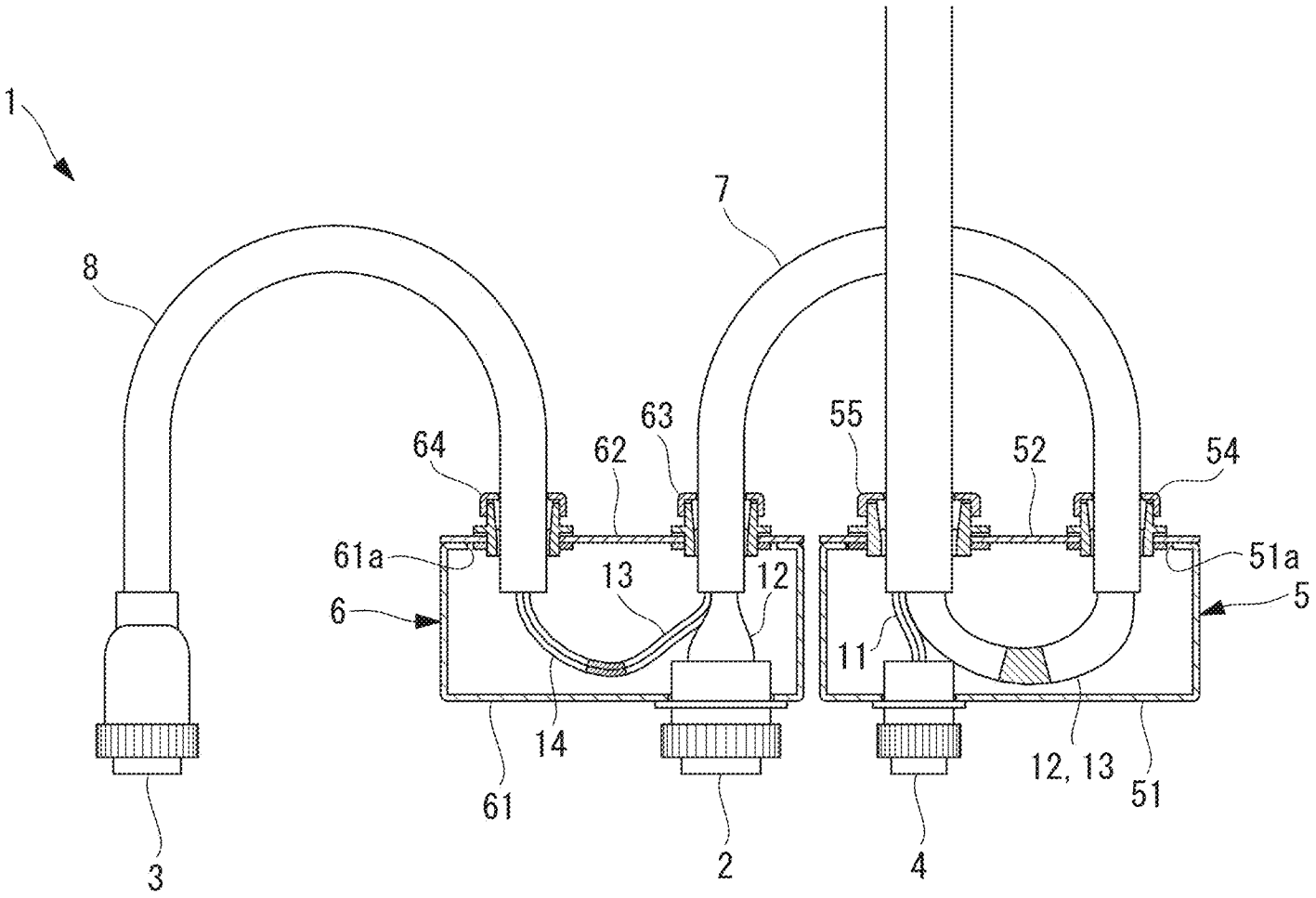
FIG. 6 is a front view showing a modification of the composite-cable relay device in FIG. 1.

In this embodiment, the case of connecting the composite cable 30 in which the composite connector 32 is attached to the end thereof has been described as an example. The present disclosure is not limited thereto, and, as shown in FIG. 6, the composite-cable relay device 1 may be configured so as to have a structure in which the composite cable 30 is attached to the first housing 5 by means of a cable clamp (connecting portion) 55. In this case, the individual wiring lines of the composite cable 30 may be connected, inside the first housing 5, to the terminals of the first relay cable 7 and the third connector (relay-side connector) 4 by means of soldering or the like.

REFERENCE SIGNS LIST

1 composite-cable relay device
2 first connector (relay-side connector)
3 second connector (relay-side connector)
4 third connector (relay-side connector)
5 first housing (hollow housing)
6 second housing (hollow housing)
7 first relay cable (relay cable)
8 second relay cable (relay cable)
11 encoder wiring (wiring)
12 motive-power wiring (wiring)
13 brake wiring (wiring)
20 motor
21 motive-power connector (motor-side connector)
22 brake connector (motor-side connector)
23 encoder connector (motor-side connector)
30 composite cable
32 composite connector (cable-side composite connector, connecting portion)
53 relay-side composite connector (connecting portion)
55 cable clamp (connecting portion)

The invention claimed is:

1. A composite-cable relay device that connects individual wiring lines of a composite cable to two or more motor-side connectors included in a motor, the composite-cable relay device comprising:

two or more relay-side connectors that are connected to the respective motor-side connectors;

hollow housings that are secured to at least one of the relay-side connectors; and a relay cable that possesses flexibility and that connects the hollow housings with the other relay-side connectors, wherein a connecting portion to which the composite cable is connected is provided in any one of the hollow housings, and, in the interior of each hollow housing, wiring to be connected to the relay-side connector secured to the hollow housing and wiring to be connected to the relay cable branch off from each other.

2. A composite-cable relay device according to claim 1, wherein the connecting portion is a relay-side composite connector to which a cable-side composite connector provided at an end of the composite cable can be connected.

3. A composite-cable relay device according to claim 1, wherein the connecting portion is a cable clamp that secures an end of the composite cable to the hollow housing.

4. A composite-cable relay device according to claim 1, wherein the hollow housing is secured to two or more of the relay-side connectors.

* * * * *